US012379154B2

(12) United States Patent
Hunter et al.

(10) Patent No.: US 12,379,154 B2
(45) Date of Patent: Aug. 5, 2025

(54) APPLIANCE MOUNTING SYSTEM

(71) Applicant: WHIRLPOOL CORPORATION, Benton Harbor, MI (US)

(72) Inventors: Lynne F. Hunter, Dorr, MI (US); Raffaella Gropallo, Milan (IT); Giulia Marinello, Milan (IT)

(73) Assignee: Whirlpool Corporation, Benton Harbor, MI (US)

( * ) Notice: Subject to any disclaimer, the term of this patent is extended or adjusted under 35 U.S.C. 154(b) by 0 days.

(21) Appl. No.: 18/402,987

(22) Filed: Jan. 3, 2024

(65) Prior Publication Data

US 2024/0142165 A1 May 2, 2024

Related U.S. Application Data

(60) Continuation of application No. 17/861,542, filed on Jul. 11, 2022, now Pat. No. 11,898,789, which is a division of application No. 17/139,102, filed on Dec. 31, 2020, now Pat. No. 11,421,933, which is a continuation of application No. 16/166,837, filed on Oct. 22, 2018, now Pat. No. 10,914,510.

(51) Int. Cl.

| | |
|---|---|
| ***F25D 23/06*** | (2006.01) |
| *A47B 88/407* | (2017.01) |
| *F25D 23/02* | (2006.01) |

(52) U.S. Cl.

CPC ..... *F25D 23/067* (2013.01); *F25D 23/066* (2013.01); *A47B 88/407* (2017.01); *F25D 23/025* (2013.01)

(58) Field of Classification Search

CPC .... F25D 23/066; F25D 23/067; A47B 88/407

See application file for complete search history.

(56) References Cited

U.S. PATENT DOCUMENTS

| | | | | |
|---|---|---|---|---|
| 3,380,615 | A * | 4/1968 | Kessler | F25D 23/085 220/592.06 |
| 4,735,470 | A | 4/1988 | Falk | |
| 5,177,976 | A | 1/1993 | Lim et al. | |
| 5,226,707 | A | 7/1993 | Han et al. | |
| 5,486,046 | A | 1/1996 | Jernstrom et al. | |
| 5,641,217 | A | 6/1997 | Caruso et al. | |
| 5,735,589 | A | 4/1998 | Herrmann et al. | |
| 5,980,058 | A | 11/1999 | Guess et al. | |
| 7,021,730 | B2 | 4/2006 | Remmers | |

(Continued)

FOREIGN PATENT DOCUMENTS

| | | | |
|---|---|---|---|
| EP | 2818814 | A2 | 12/2014 |
| EP | 3279592 | A1 | 2/2018 |
| WO | 2012007284 | A2 | 1/2012 |

*Primary Examiner* — James O Hansen

(74) *Attorney, Agent, or Firm* — Price Heneveld LLP

(57) ABSTRACT

An appliance mounting device is provided herein. The appliance includes a vacuum insulated structure having a liner positioned within a wrapper, wherein the liner and wrapper cooperate to define an interior cavity. The appliance further includes an insulating material positioned within the interior cavity and a hanger coupled to an adapter plate and a support member. The support member is configured to couple to an interior surface of the vacuum insulated structure while maintaining a vacuum in the interior cavity and a holding member is coupled to a first side of the adapter plate and configured to receive a positioning member.

15 Claims, 11 Drawing Sheets

(56) References Cited

U.S. PATENT DOCUMENTS

| | | | | |
|---|---|---|---|---|
| 8,240,791 | B2 | 8/2012 | Benz et al. | |
| 8,641,158 | B1 * | 2/2014 | Conner, Sr. | A47F 3/08 312/408 |
| 2003/0173882 | A1 | 9/2003 | Koons | |
| 2007/0228911 | A1 | 10/2007 | Kim et al. | |
| 2008/0036349 | A1 * | 2/2008 | Crompton | F25D 23/062 312/401 |
| 2009/0056365 | A1 | 3/2009 | Benz et al. | |
| 2010/0019641 | A1 | 1/2010 | Laible et al. | |
| 2012/0146477 | A1 | 6/2012 | Bischofberger et al. | |
| 2013/0257254 | A1 | 10/2013 | Austin et al. | |
| 2014/0265801 | A1 | 9/2014 | Klitzing et al. | |
| 2014/0375199 | A1 | 12/2014 | Lee et al. | |
| 2016/0153699 | A1 | 6/2016 | Lee et al. | |
| 2016/0290711 | A1 | 10/2016 | Brown et al. | |
| 2017/0191742 | A1 | 7/2017 | Lim et al. | |
| 2017/0191743 | A1 | 7/2017 | Lee et al. | |
| 2018/0038630 | A1 | 2/2018 | Biotti et al. | |
| 2018/0058750 | A1 * | 3/2018 | Rotter | F25D 25/02 |

* cited by examiner

APPLIANCE MOUNTING SYSTEM

CROSS-REFERENCE TO RELATED APPLICATIONS

The present application is a continuation of U.S patent application Ser. No. 17,861,542, filed Jul. 11, 2022, now U.S. Pat. No. 11,898,789, entitled APPLIANCE MOUNTING SYSTEM, which is a divisional of U.S. patent application Ser. No. 17/139,102, filed Dec. 31, 2020, entitled APPLIANCE MOUNTING SYSTEM, which is a continuation of U.S. patent application Ser. No. 16/166,837, filed Oct. 22, 2018, entitled APPLIANCE MOUNTING SYSTEM, now issued as U.S. Pat. No. 10,914,510, the disclosures to which are each hereby incorporated herein by reference in their entirety.

FIELD OF THE DISCLOSURE

The present disclosure generally relates to an appliance mounting system, and more specifically, a mounting system for an appliance having a vacuum insulated structure.

BACKGROUND OF THE DISCLOSURE

Attaching crispers, drawers, racks, and other containers to the interior of an appliance's vacuum insulated structure can be problematic. Many of the existing solutions used to mount holders in an appliance such as, for example, a refrigerator, would require the vacuum insulated structure surface be perforated and, therefore, defeat the purpose of having the vacuum insulation. In many cases, traditional refrigerators include foam insulation; however, when foam insulation is used, holders are often mounted to the refrigerator by drilling into the foam. Other existing solutions require items, such as food and/or bottles, to be positioned on a floor of the vacuum insulated structure; however, many vacuum insulated structures lack a substantially flat floor necessary for storing such items on the vacuum insulated structure floor. Further, many of the food and/or bottles lack a substantially flat bottom preventing storage of those items on the floor of a vacuum insulated structure.

Accordingly, new solutions and techniques to attach a mounting system to an interior surface of a vacuum insulated structure without compromising the vacuum insulated structure are needed. It is therefore desired to implement new approaches, devices, and/or methods to be used in vacuum insulated appliances.

SUMMARY OF THE DISCLOSURE

According to one aspect of the present disclosure, an appliance is disclosed. The appliance includes a vacuum insulated structure having a liner positioned within a wrapper. The liner and wrapper cooperate to define an interior cavity and an insulating material is positioned within the interior cavity and a hanger is coupled to an adapter plate and a support member. The support member is configured to couple to an interior surface of the vacuum insulated structure while maintaining a vacuum in the interior cavity. Additionally, a holding member is coupled to a first side of the adapter plate and configured to receive a positioning member.

According to another aspect of the present disclosure, a vacuum insulated mounting system is disclosed. The vacuum insulated mounting system includes a vacuum insulated structure having a liner positioned within a wrapper.

The liner and wrapper cooperate to define an interior cavity and an insulating material positioned within the interior cavity. The vacuum insulated mounting system further includes a support member defining one or more apertures coupled to an interior surface of the vacuum insulated structure. Additionally, a panel having one or more protrusions configured to correspond with the one or more apertures is removably coupled to the support member.

According to still other aspects of the present disclosure, a refrigerator is disclosed. The refrigerator includes a vacuum insulated structure having a liner positioned within a wrapper. The liner and wrapper cooperate to define an interior cavity and an insulating material is positioned within the interior cavity. Additionally, the refrigerator includes a mounting system. The mounting system further includes a support member defining an aperture and an engagement member having a protrusion configured to correspond to one of the aperture. The engagement member is coupled to the support member and the support member is further coupled to an interior surface of the vacuum insulated structure.

These and other aspects, objects, and features of the present disclosure will be understood and appreciated by those skilled in the art upon studying the following specification, claims, and appended drawings.

DETAILED DESCRIPTION OF THE PREFERRED EMBODIMENTS

Figure 1:
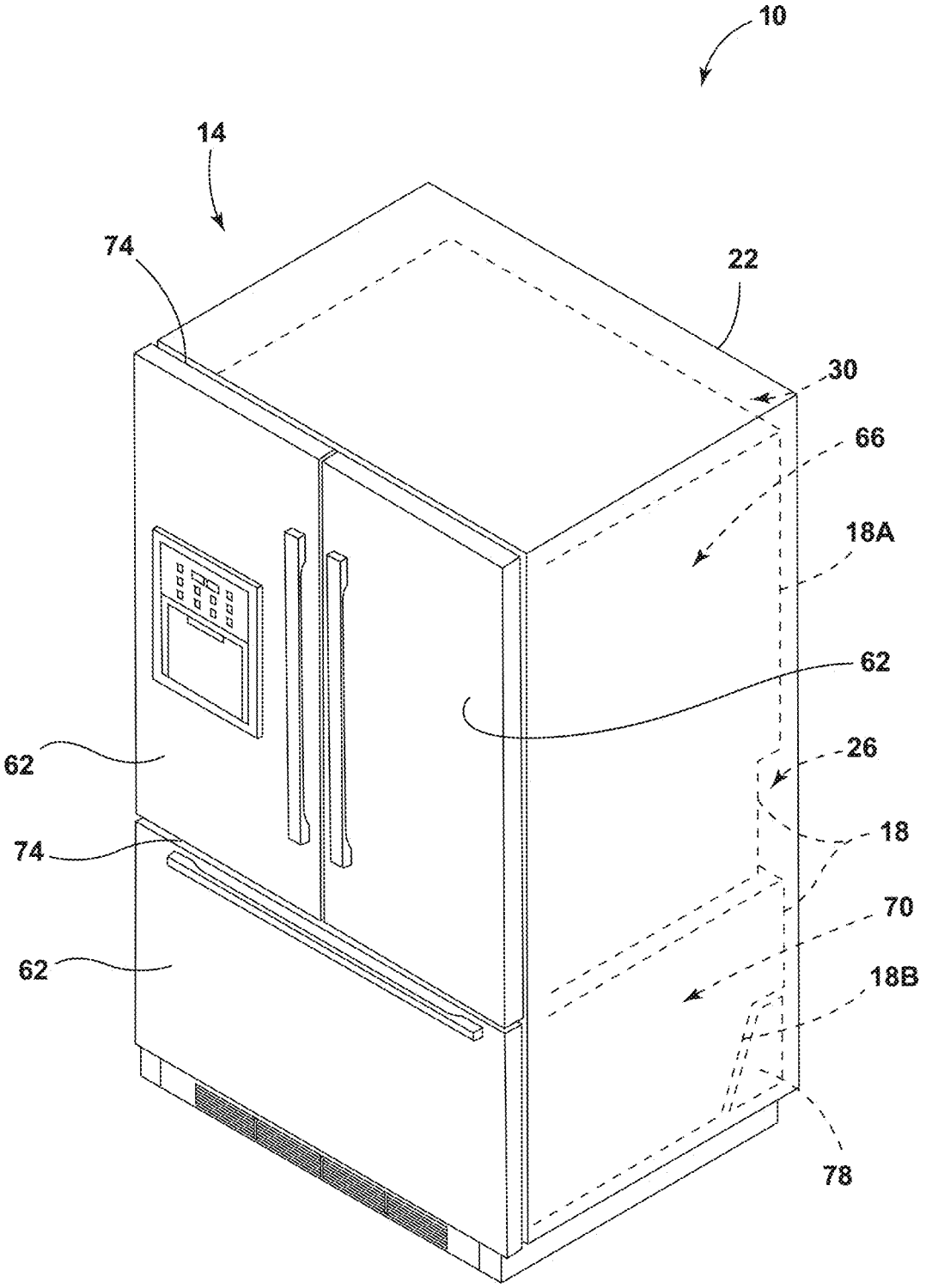
FIG. 1 is a front isometric view of a refrigerator including a vacuum insulated structure according to one aspect of the present disclosure.

For purposes of description herein the terms "upper," "lower," "right," "left," "rear," "front," "vertical," "horizontal," and derivatives thereof shall relate to the device as oriented in FIG. 1. However, it is to be understood that the device may assume various alternative orientations and step sequences, except where expressly specified to the contrary. It is also to be understood that the specific devices and processes illustrated in the attached drawings, and described in the following specification are simply exemplary embodiments of the inventive concepts defined in the appended claims. Hence, specific dimensions and other physical characteristics relating to the embodiments disclosed herein are not to be considered as limiting, unless the claims expressly state otherwise.

As used herein, the terms "comprises," "comprising," or any other variation thereof, are intended to cover a non-exclusive inclusion, such that a process, method, article, or apparatus that comprises a list of elements does not include only those elements but may include other elements not expressly listed or inherent to such process, method, article, or apparatus. An element preceded by "comprises . . . a" does not, without more constraints, preclude the existence of additional identical elements in the process, method, article, or apparatus that comprises the element.

As used herein the terms "the," "a," or "an," mean "at least one," and should not be limited to "only one" unless explicitly indicated to the contrary. Thus, for example, reference to "a component" includes embodiments having two or more such components unless the context clearly indicates otherwise.

Further, as used herein, the term "and/or," when used in a list of two or more items, means that any one of the listed items can be employed by itself, or any combination of two or more of the listed items can be employed. For example, if a composition is described as containing components A, B, and/or C, the composition can contain A alone; B alone; C alone; A and B in combination; A and C in combination; B and C in combination; or A, B, and C in combination.

Ranges can be expressed herein as from "about" one particular value, and/or to "about" another particular value. As used herein, the term "about" means that amounts, sizes, formulations, parameters, and other quantities and characteristics are not and need not be exact, but may be approximate and/or larger or smaller, as desired, reflecting tolerances, conversion factors, rounding off, measurement error, and the like, and other factors known to those skilled in the art. When the term "about" is used in describing a value or an end-point of a range, the disclosure should be understood to include the specific value or end-point referred to. Whether or not a numerical value or end-point of a range in the specification recites "about," the numerical value or end-point of a range is intended to include two embodiments: one modified by "about" and one not modified by "about." It will be further understood that the endpoints of each of the ranges are significant both in relation to the other endpoint, and independently of the other endpoint.

Referring to FIGS. 1-11, reference numeral 10 generally refers to an appliance having a vacuum insulated structure 14. The vacuum insulated structure 14 may have a liner 18 positioned within a wrapper 22. The liner 18 and wrapper 22 may cooperate to define an interior cavity 26. An insulating material 30 may be positioned within the interior cavity 26. A hanger 34 may be coupled to both an adapter plate 38 and a support member 42. The support member 42 may be coupled to an interior surface 46 of the vacuum insulated structure 14. A holding member 50 may be coupled to a first side 54 of the adapter plate 38 and be configured to receive a positioning member 58.

Referring now to FIG. 1, the vacuum insulated structure 14 includes the liner 18, the wrapper 22, and a thermal bridge 60 (FIG. 2) that interconnects the wrapper 22 and liner 18. The liner 18 may include a single, one-piece liner, or the liner 18 may include two or more components such as a refrigerator liner 18A and a freezer liner 18B. The vacuum insulated structure 14 depicted in FIG. 1 is a French door bottom mount refrigerator, but it will be understood that this disclosure may equally be applied to freezers, walk in coolers, and the like, without departing from the teachings provided herein. In various examples, the vacuum insulated structure 14 may be, for example, a wall, a plurality of walls defining a cavity, a panel, and/or a cabinet. The vacuum insulated structure 14 may include one or more appliance doors 62 which may be opened to allow users of the vacuum insulated structure 14 to place or remove items from within a refrigerator compartment 66 and/or a freezer compartment 70 through one or more access openings 74. The interior cavity 26 is formed between the wrapper 22 and the liner 18 where the insulating material 30 may be added as described below.

A refrigeration system 78 cools the refrigerator compartment 66 and/or the freezer compartment 70. The refrigeration system 78 may include known systems such as, for example, a compressor, condenser, expansion valve, evaporator, conduits, and other related components. Alternatively, the refrigeration system 78 may include thermal electric components, or other suitable arrangements depending on the desired use or application.

Figure 2:
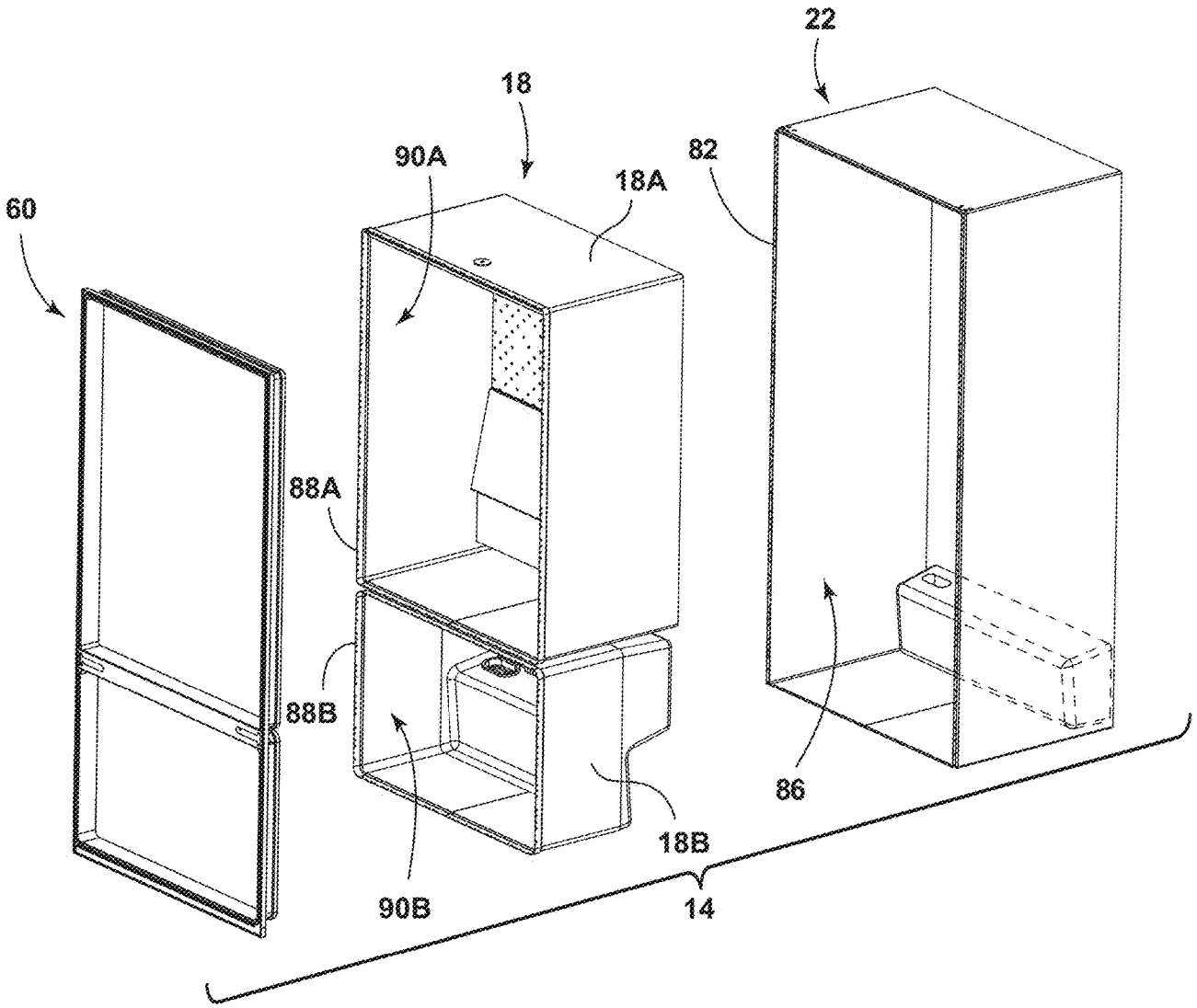
FIG. 2 is an exploded side isometric view of a cabinet of the refrigeration structure according to one aspect of the present disclosure.

Referring now to FIG. 2, the vacuum insulated structure 14 when assembled (FIG. 1), includes the liners 18, both the refrigerator liner 18A and the freezer liner 18B, disposed in the wrapper 22 therein. The wrapper 22 and the liner 18 (or liners 18A and 18B) are coupled to the insulating thermal bridge 60. The wrapper 22 is connected to the insulating thermal bridge 60 at a first edge 82. The first edge 82 extends around a first opening 86 of the wrapper 22. Refrigerator liner 18A and the freezer liner 18B include second edges 88A and 88B, respectively, extending around second openings 90A and 90B, respectively, representing the refrigerator and freezer compartments 66, 70. The second edges 88A and 88B are coupled to the insulating thermal bridge 60.

Figure 3:
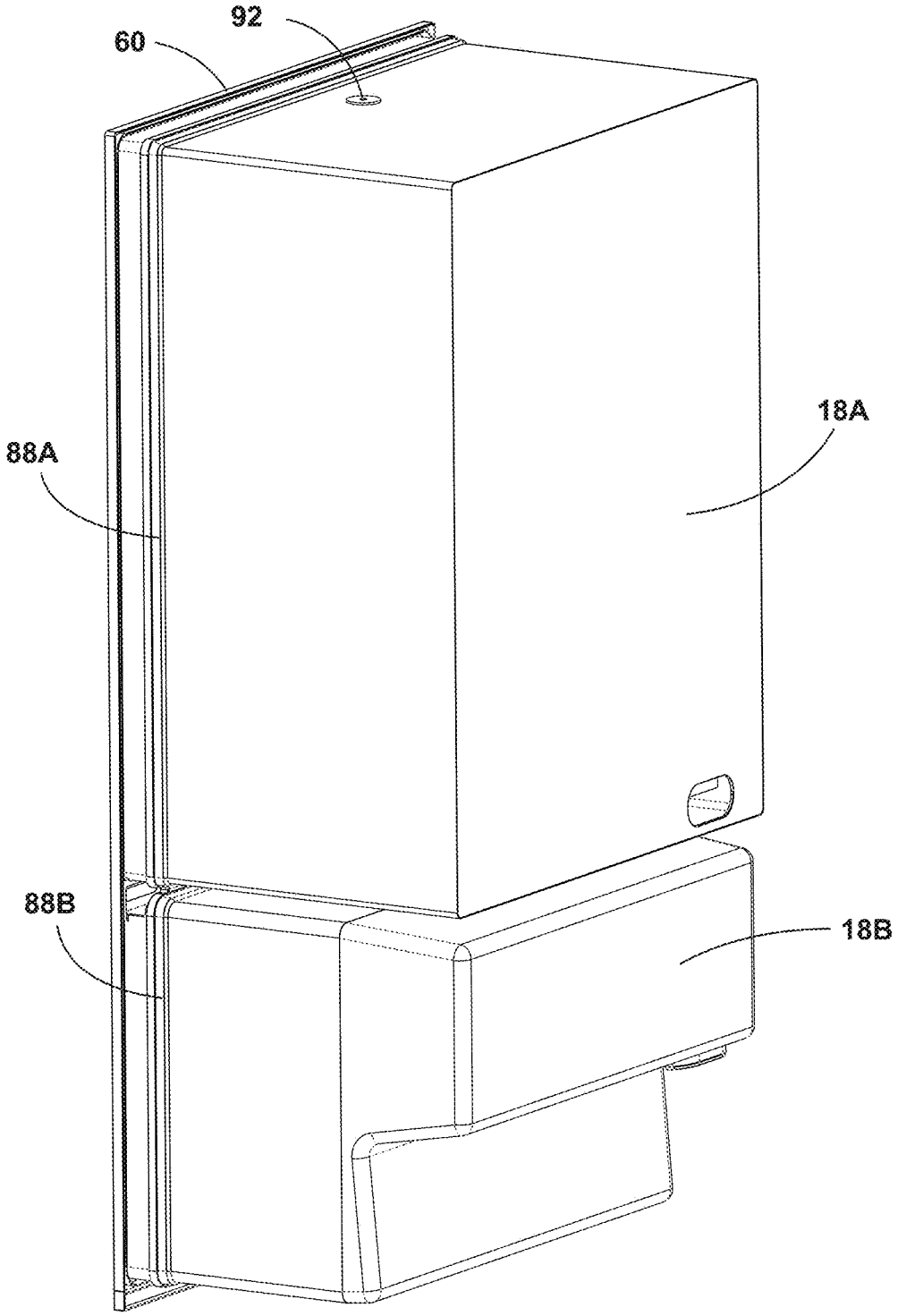
FIG. 3 is a rear side isometric view of a refrigerator liner and a freezer liner attached to an insulating thermal bridge according to one aspect of the present disclosure.

Referring to FIG. 3, the refrigerator liner 18A and the freezer liner 18B are coupled to the insulating thermal bridge 60 at the second edges 88A and 88B (see also FIG. 2). In some examples, a vacuum port 92 may be positioned in the refrigerator liner 18A in order to evacuate the interior cavity 26 (FIG. 1) having a filler insulation material.

The insulating material 30 may be formed from various porous/permeable filler materials such as open cell foam, glass fibers, silica, or other suitable materials. In some aspects, the insulating material 30 may be a fumed silica or a silica powder. After storage at room temperature or other non-environmentally controlled conditions, the insulating material 30 will have a certain amount of adsorbed water on the surface and pores of the fumed silica or other insulating material 30. In typical packing processes used for vacuum insulated structures 14, the insulating material 30 is added directly from the packaging as shipped to the interior cavity 26 (FIG. 1) of the vacuum insulated structures 14 and a vacuum with heat is applied to the vacuum insulated structure 14 itself. Such loading or packing processes are inefficient and take considerable amounts of time because the loaded water on the insulating material 30 must be drawn off before desired vacuum levels can be obtained.

Figure 4:
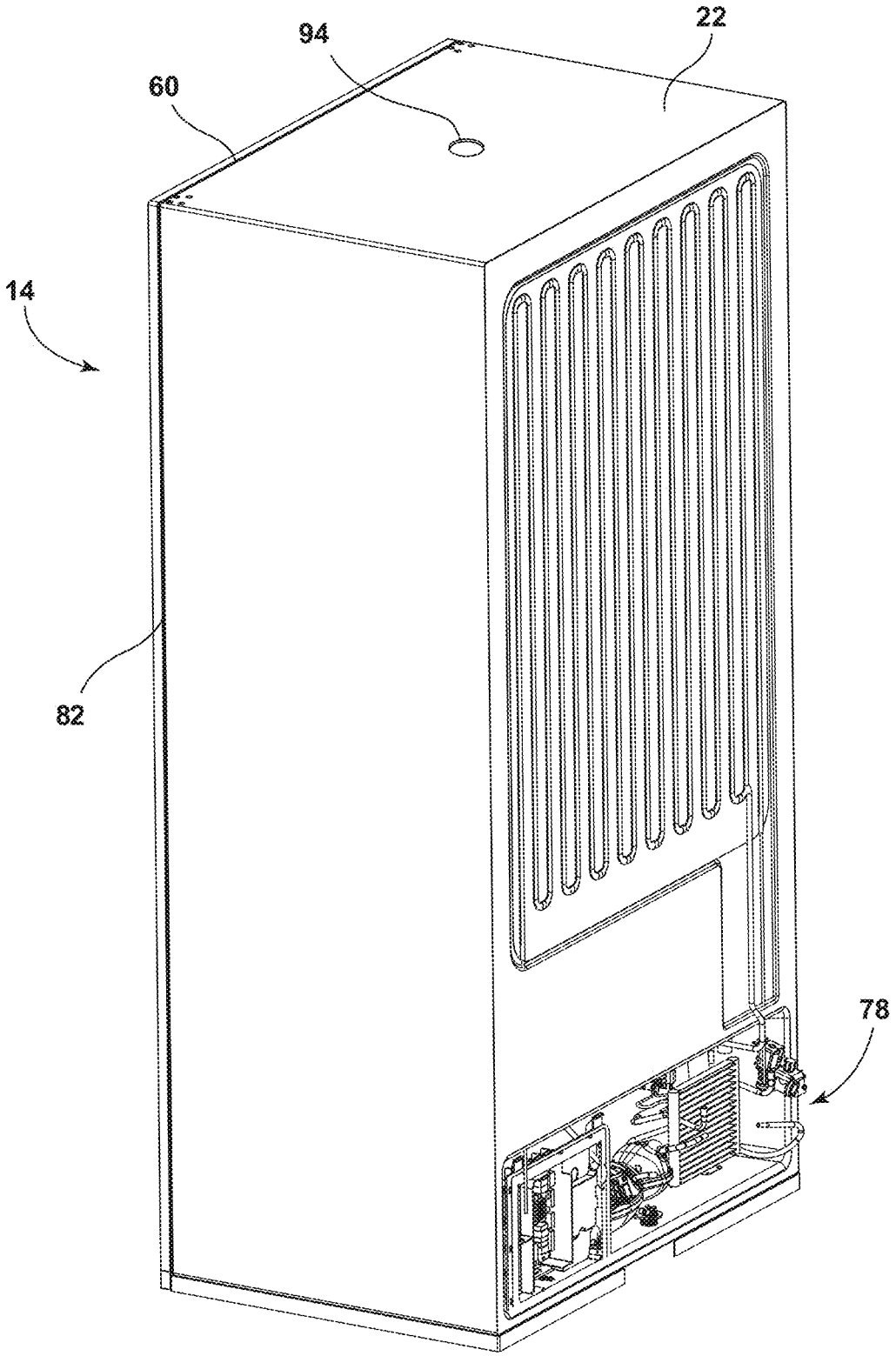
FIG. 4 is a rear isometric view of a vacuum insulated structure according to one aspect of the present disclosure.
Figure 5:
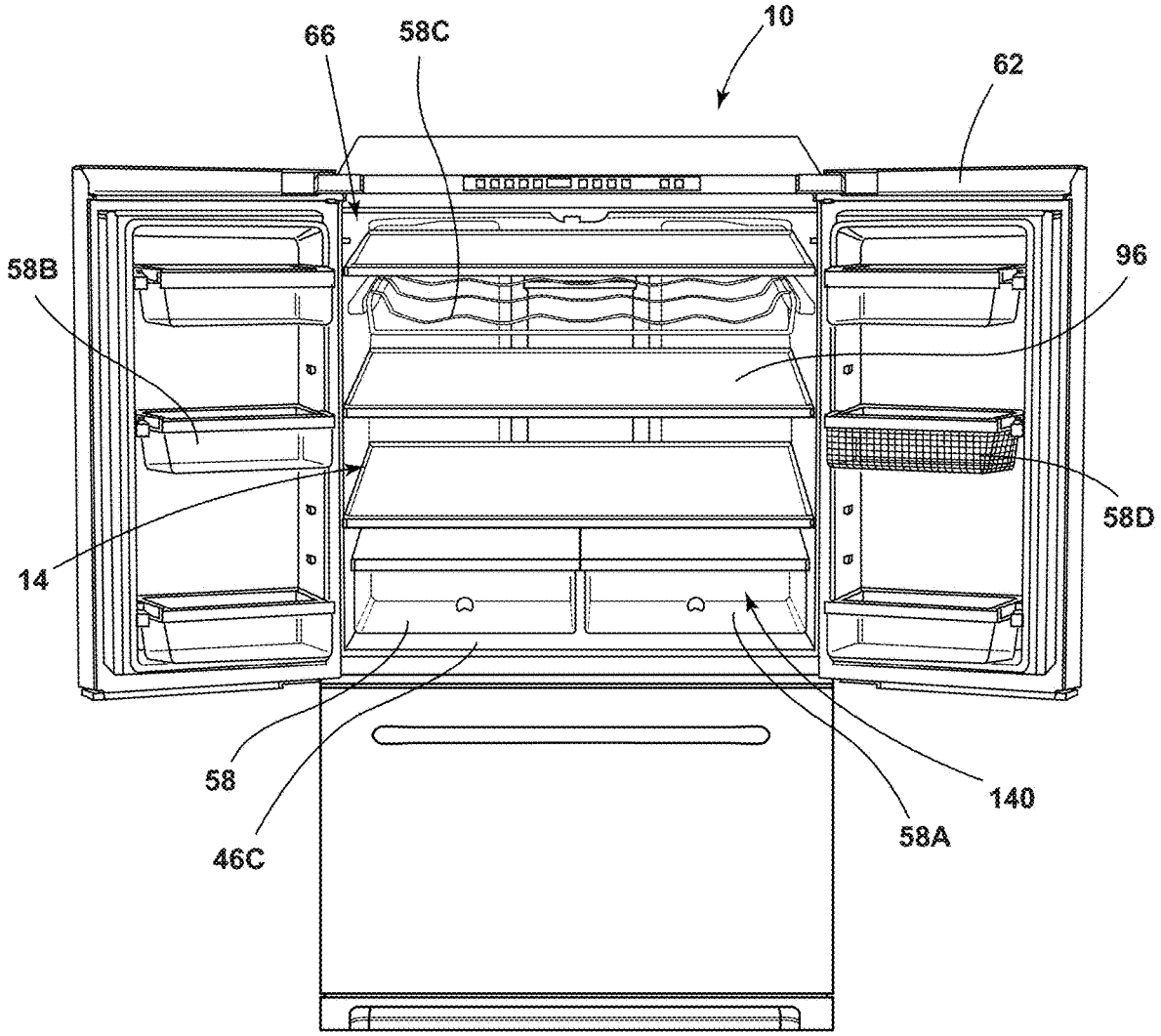
FIG. 5 is a front view of an interior of a refrigerator compartment according to some embodiments of the present disclosure.
Figure 6:
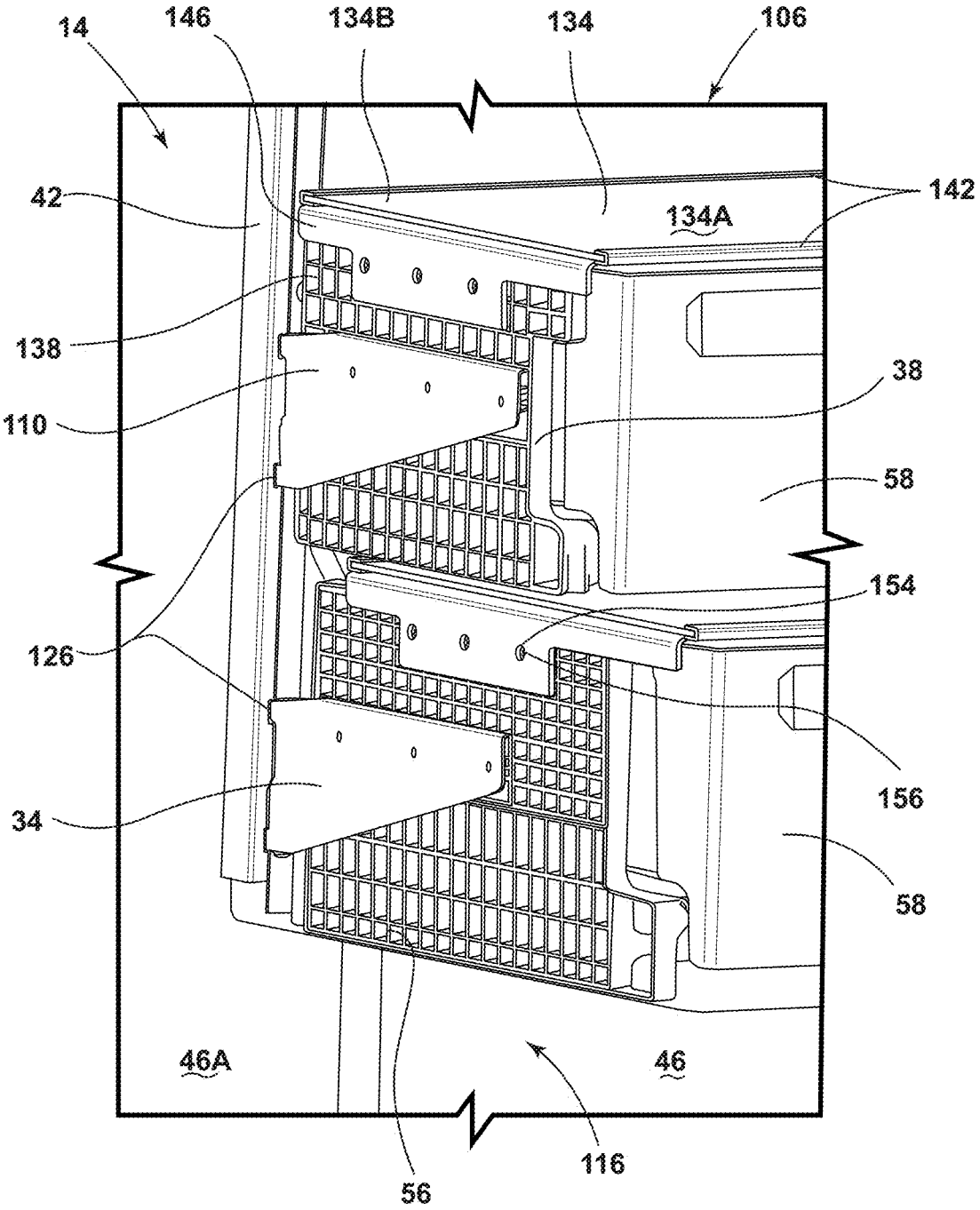
FIG. 6 is a partial view of a mounting system within an appliance according to some embodiments of the present disclosure.

Still referring to FIG. 4, the vacuum insulated structure 14 includes the wrapper 22 coupled to the thermal bridge 60 through the first edge 82. A fill hole 94 is shown positioned in a top surface of the wrapper 22 can be coupled to load a dry and degassed filler insulation material to the interior cavity 26 (FIG. 1) of the vacuum insulated structure 14 (as shown in FIGS. 5-6). The positioning of the fill hole 94 is not meant to be limiting and may be positioned in any surface of the wrapper 22 or liner 18 to load the dry and degassed filler insulation material. In some examples, the fill hole 94 may be positioned in the top, back, and/or side walls of the wrapper 22. In some examples, there may be more than one fill hole 94, for example, separate fill holes 94 for the refrigerator and freezer compartments 66, 70.

Referring to FIG. 5, the refrigerator compartment 66 of the appliance 10 may include a shelf 96 coupled to an interior surface 46 of the vacuum insulated structure 14. The shelf 96 may have a substantially flat surface or it may be curved to assist in supporting bottles. The refrigerator compartment 66 may include a positioning member 58. The positioning member 58 may include a plurality of positioning members 58 such that the positioning member 58 may be coupled to the interior surface 46 of the vacuum insulated structure 14, the appliance doors 62, and/or a combination thereof.

Still referring to FIG. 5, the positioning member 58 may be, for example, a crisper 58A, a chiller bin 58B, a wire rack 58C, a basket 58D, the shelf 96, and/or a combination thereof. In some examples, the positioning member 58 may have substantially continuous walls and may be configured as a substantially rectangular container configured to hold food items such as, for example, the crisper 58A or the chiller bin 58B. It may be advantageous to have a substantially rectangular positioning member 58, such as, for example, the crisper 58A to have continuous such that the crisper 58A may be configured as a drawer within the appliance 10. In other examples, the positioning member 58 may be configured as the basket 58D to assist in folding food items such as, for example, fruits, vegetables, and/or various food containers.

In still other examples, the positioning member 58 may be configured as the wire rack 58C defining a plurality of apertures. The wire rack 58C may include elongated wire-like support members coupled together to support, for example, drink bottles. The wire-like support members may be curved to assist in supporting the bottles positioned thereon. The plurality of apertures defined by the wire rack 58C may be spaced apart in a manner sufficient to cradle a standard sized bottle such as, for example, a soda can or a wine bottle. In some examples, the positioning member 58 may be configured to support condiment bottles. The appliance 10 may include the plurality of positioning members 58 where the plurality of positioning members 58 are substantially similar. In other examples, the appliance 10 may include the plurality of positioning members 58 where the plurality of positioning members 58 differ such that, for example, the appliance 10 includes a combination of the crisper 58A, the chiller bin 58B, the wire rack 58C, and the basket 58D.

Referring now to FIG. 6, the positioning member 58 may be coupled to the interior surface 46 of the vacuum insulated structure 14 by a mounting system 106. In various examples, the mounting system 106 may include the support member 42 and an engagement member 110. In various examples, the engagement member 110 may have substantially flat sides. In some examples, the engagement member 110 may be configured to couple to the support member 42 and extend horizontally therefrom towards an interior 116 of the vacuum insulated structure 14. In some examples, the engagement member 110 may be configured to support other aspects of the mounting system 106 such as, for example, the adapter plate 38, a panel 114 (FIG. 10), and/or a combination thereof. In some examples, the engagement member 110 may be the hanger 34. In other examples, the engagement member 110 may be the panel 114 (FIG. 10). In still other examples, the mounting system 106 may include the hanger 34 coupled to a second side 56 of the adapter plate 38 and the holding member 50 (FIG. 9) coupled to the first side 54 of the adapter plate 38, where the first and second sides 54, 56 may be opposing lateral sides of the adapter plate 38. In various examples, the positioning member 58 may not be directly coupled to the support member 42.

In various examples, the mounting system 106 may be configured to couple to the interior surface 46 of the vacuum insulated structure 14 while maintaining a vacuum in the interior cavity 26. In various examples, the mounting system 106 may be welded to the interior surface 46 and/or coupled to the interior surface 46 by adhesive such that the mounting system 106 is positioned on the interior surface 46 while maintaining a vacuum in the interior cavity 26.

Referring still to FIG. 6, the support member 42 may be coupled to the interior surface 46 of the vacuum insulated structure 14. In some examples, the support member 42 may be coupled to a rear surface 46A of the vacuum insulated structure 14. In other examples, the support member 42 may be coupled to a top surface 46B (FIG. 10) of the vacuum insulated structure 14. In still other examples, the support member 42 may be coupled to a side surface of the vacuum insulated structure 14. The support member 42 may be coupled to the interior surface 46 by welding, adhesive, fasteners, or other attachment methods.

Still referring to FIG. 6, the support member 42 may be a substantially linear structure.

In various examples the support member 42 defines one or more apertures 126. The apertures 126 may be uniformly positioned across a length of the support member 42. In other examples the apertures 126 may not be uniformly positioned. The apertures 126 may be formed in a shape and size sufficient to cooperate with the engagement member 110 to assist in coupling the engagement member 110 to the support member 42. In some examples, the support member 42 may be a ladder rack. In some examples, the support member 42 may be formed from, for example, plastic, acrylic, plexiglass, polypropylene, or polycarbonate. In other examples, the support member 42 may be formed from, for example, a metal alloy.

With further reference to FIG. 6, the mounting system 106 may include a cover panel 134 coupled to a top edge portion 138 of the adapter plate 38. The cover panel 134 may have a substantially flat top surface 134A such that the cover panel 134 may be configured as the shelf 96 (FIG. 5). In various examples, the cover panel 134 extends over a portion of a width of the positioning member 58. In other examples, the cover panel 134 extends of the entire width of the positioning member 58 such that the cover panel 134 and the positioning member 58 may define a cavity 140 therebetween (FIG. 5). In some examples, a border member 142 coupled to the cover panel 134. The border member 142 may be coupled to the cover panel 134 or may be integrally formed with the cover panel 134. In various examples, the border member 142 wraps around an edge portion 134B of the cover panel 134 and extends above the top surface 134A of the cover panel 134. It may be advantageous to include the border member 142 to assist in retaining bottles and other food items positioned on the cover panel 134 when the cover panel 134 is configured as the shelf 96 (FIG. 5).

In various examples, the cover panel 134 may be coupled to the top edge portion 138 of the adapter plate 38 by a bracket 146. The bracket 146 may be coupled to the second side 56 of the adapter plate 38. In some examples, the bracket 146 may be curved, such that the bracket 146 is coupled to the cover panel 134 and extends horizontally therefrom and then extends at a downward angle to couple to the adapter plate 38. In other examples, the bracket 146 may include one or more receiving members 154 configured to receive one or more fasteners 156 that may be positioned within the receiving members 154. In still other examples, the bracket 146 may be coupled to the cover panel 134 by, for example, fasteners, adhesive, and welding. In some examples, the cover panel 134 may be coupled to the top edge portion 138 of the adapter plate 38 by, for example, fasteners, snaps, screws, welding, adhesive, or other attachment methods. The cover panel 134 may be formed from, for example, plastic, acrylic, plexiglass, polypropylene, polycarbonate, and metal alloy.

Figure 7:
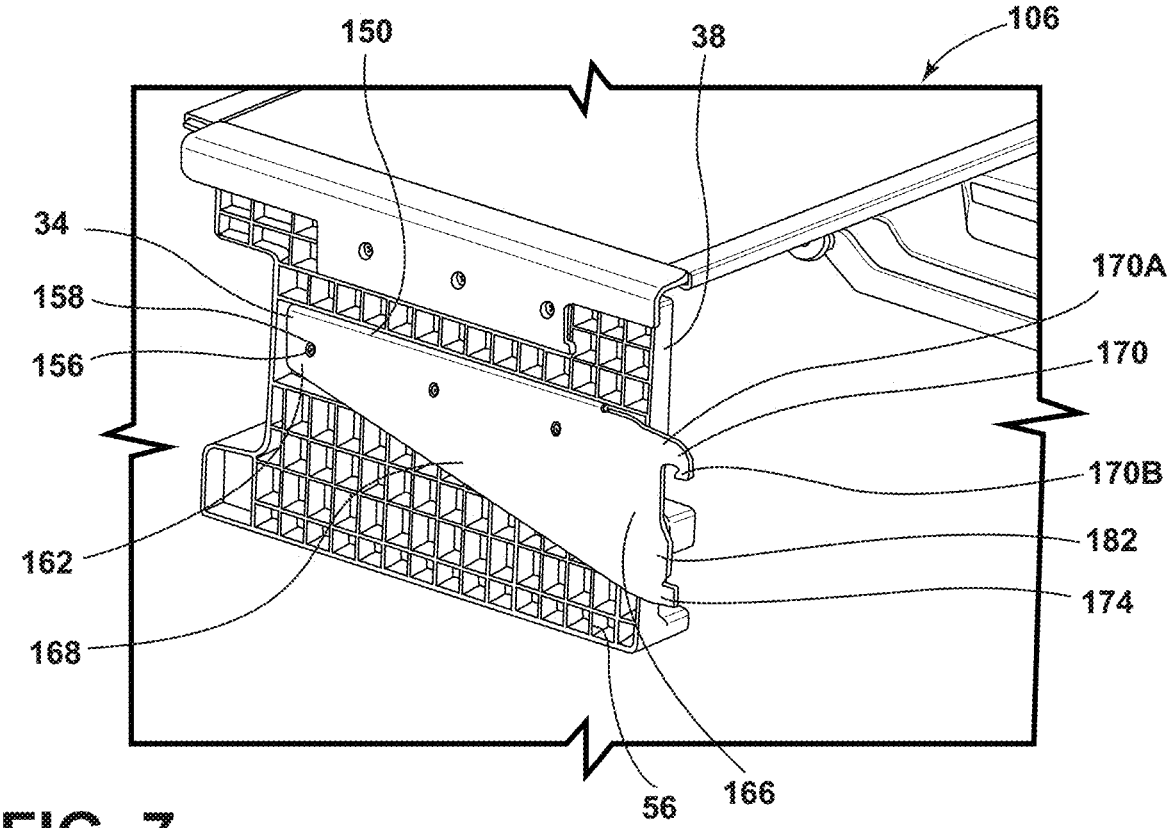
FIG. 7 is a partial rear view of the mounting system of FIG. 5 according to some embodiments of the present disclosure.

Referring now to FIG. 7, the hanger 34 is coupled to the second side 56 of the adapter plate 38. The hanger 34 may be coupled to the adapter plate 38 by, for example, screws, fasteners, snaps, adhesive, or other attachment methods. In some examples, the hanger 34 may include the receiving members 154 configured to receive the one or more fasteners 156 that may be positioned within the receiving members 154. In some examples, the hanger 34 may have substantially flat sides such that when the hanger 34 is coupled to the adapter plate 38 the hanger 34 extends a uniform distance from the adapter plate 38. In other examples, the hanger 34 may have a top edge portion 150 that curves such that the top edge portion 150 extends toward the adapter plate 38. In various examples, the hanger 34 may have a first edge portion 162 and a second edge portion 166, where the first and second edge portions 162, 166 may have a substantially similar length. In other examples, the second edge portion 166 may have a longer length compared to the first edge portion 162, such that a bottom edge portion 168 extends downward at an angle between the first edge portion 162 and the second edge portion 166. In other words, the second edge portion 166 may be a rear edge portion and the first edge portion 162 may be a front edge portion where the second edge portion 166 may be longer than the first edge portion 162. The first edge portion 162 may be proximate the positioning member 58 (FIG. 5) and the second edge portion 166 may include one or more hooks 170. In various examples, the hanger 34 may be formed from metal, such as steel or other metal alloys. In some examples, the hanger 34 may be formed from composite materials, such as fiber reinforced plastics.

Still referring to FIG. 7, the hanger 34 may include the hooks 170 coupled to the second edge portion 166. In various examples, the hook 170 may extend outwardly opposite the first edge portion 162 from the top edge portion 150 of the hanger 34. The hook 170 may be coupled to the hanger 34 or may be integrally formed with the hanger 34. In various examples, the hanger 34 and the hook 170 may have substantially similar thicknesses. In some examples, the hook 170 may extend from the second edge portion 166 of the hanger 34 towards the rear surface 46A (FIG. 6) of the vacuum insulated structure 14. The hook 170 may have a first portion 170A that extends towards the rear surface 46A (FIG. 6) of the vacuum insulated structure 14 and a second portion 170E3 that extends towards a bottom surface 46C (FIG. 5) of the vacuum insulated structure 14. In various examples, the hook 170 may be configured to correspond with one of the apertures 126 (FIG. 6) defined by the support member 42 (FIG. 6) to assist in removably coupling the hanger 34 to the support member 42. In various examples the first portion 170A of the hook 170 may be configured to extend through one of the apertures 126 (FIG. 6) and the second portion 170E3 may extend downward on an opposing side of the support member 42.

With further reference to FIG. 7, the hanger 34 may include a first flange 174. The first flange 174 may be coupled to the hanger 34 or may be integrally formed with the hanger 34. The first flange 174 may extend from the bottom edge portion 168 of the hanger 34. In various examples, the first flange 174 may extend towards the rear surface 46A of the vacuum insulated structure 14 (FIG. 5). The first flange 174 may have a substantially similar thickness as the hanger 34 and/or the hook 170. In various examples, the first flange 174 may be configured to line up and be inserted into one of the apertures 126 defined by the support member 42 (FIG. 6) to assist in removably coupling the hanger 34 to the support member 42. In some examples, the hanger 34 may include a second flange 182. The first flange 174 may extend a farther distance from the hanger 34 relative to the second flange 182. In some examples, the second flange 182 may be configured to be positioned on the support member 42 (FIG. 5) to assist in stabilizing the mounting system 106.

Figure 8:
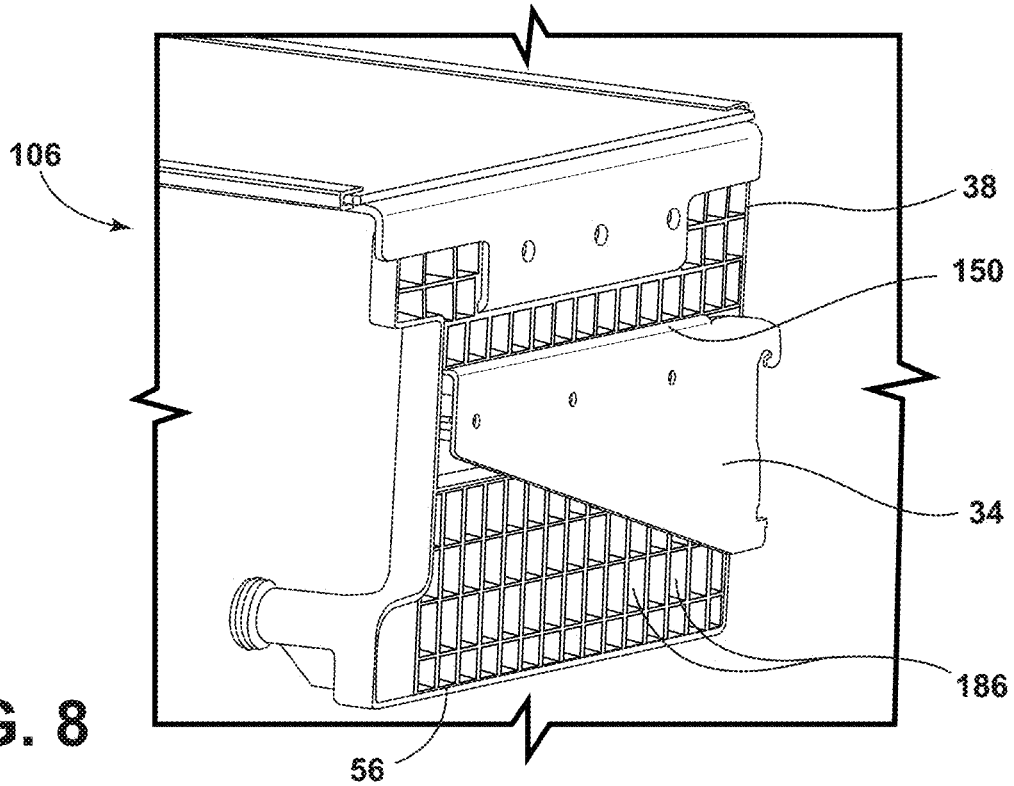
FIG. 8 is a partial front view of the mounting system of FIG. 5 according to some embodiments of the present disclosure.

Referring to FIG. 8, the hanger 34 may be positioned proximate to the adapter plate 38. In various examples, the top edge portion 150 of the hanger 34 may curve into at least one of one or more cavities 186 defined by the second side 56 of the adapter plate 38. In some examples, the cavities 186 may define a uniform pattern extending over a portion of the second side 56. In other examples, the cavities 186 may not uniformly extend across the second side 56. In other examples, the cavities 186 may be different sizes positioned on different portions of the adapter plate 38. In various examples, the cavities 186 may form, for example, a square, rectangular, diamond, or triangular shape. In some examples, the cavities 186 may define, for example, a checkerboard or honeycomb pattern. The cavities 186 may be advantageous in regards to reducing cost of production, cost of materials, and/or reduced weight of the mounting system 106.

Figure 9:
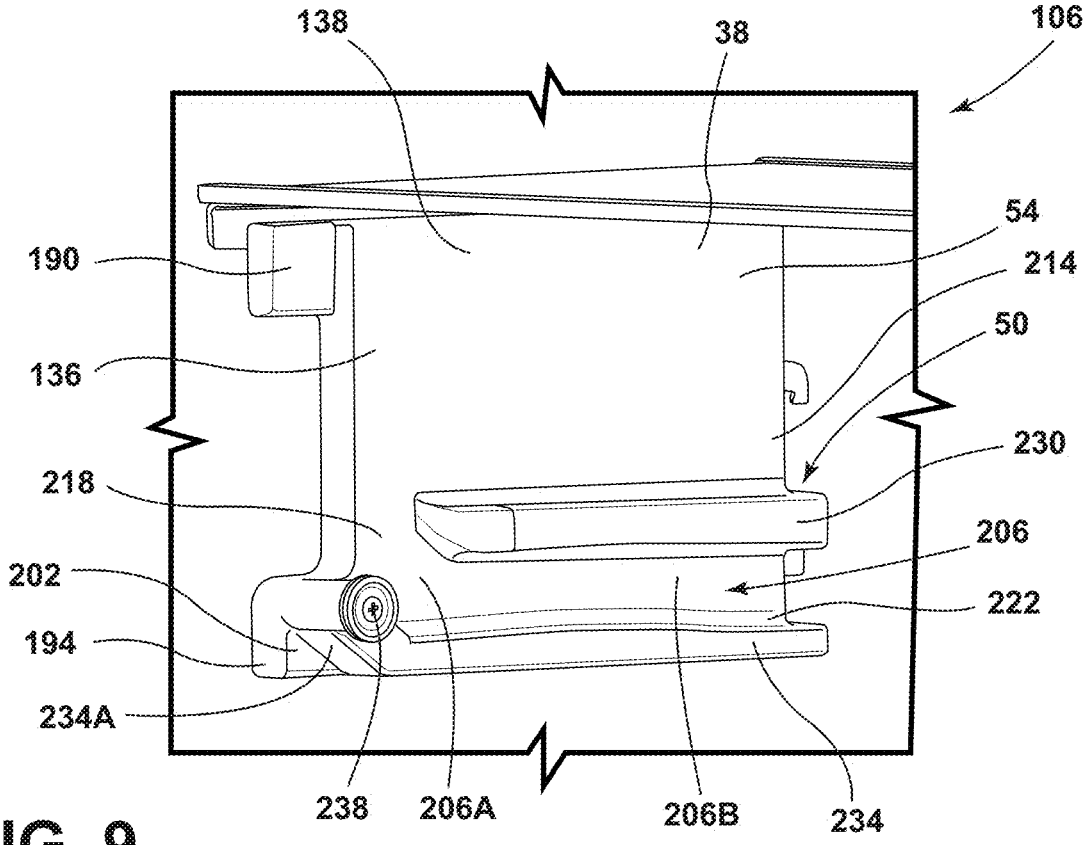
FIG. 9 is a partial view of the adapter plate of the mounting system of FIG. 5 according to some embodiments of the present disclosure.
Figure 10:
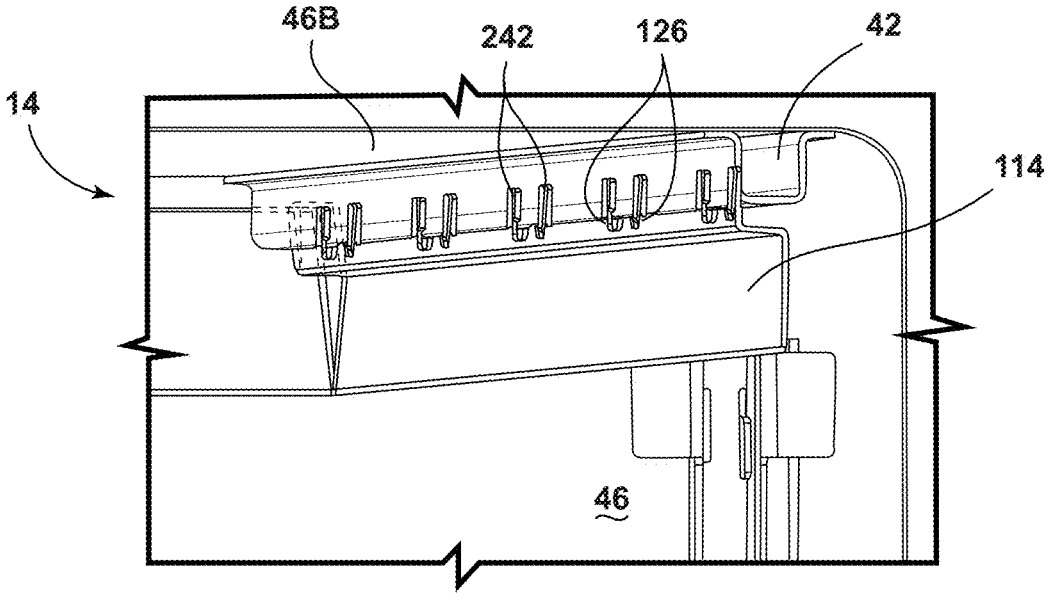
FIG. 10 is a front perspective view of a mounting system for a top interior surface of an appliance according to some embodiments of the present disclosure.

Referring now to FIG. 9, the adapter plate 38 may include a first elongated portion 190 and a second elongated portion 194. The first and second elongated portions 190, 194 may extend from a front portion 136 of the adapter plate 38 towards the appliance doors 62 of the appliance 10 (FIG. 5). The first elongated portion 190 may extend from the top edge portion 138 and the second elongated portion 194 may extend from a bottom edge portion 202 of the adapter plate 38. In various examples, the first and second elongated portions 190, 194 may extend substantially similar lengths from the adapter plate 38. In some examples, the first and second elongated portions 190, 194 may be coupled to the adapter plate 38. In other examples, first and second elongated portions 190, 194 may be integrally formed with the adapter plate 38.

Referring still to FIG. 9, the adapter plate 38 may be formed from plastics, such as, polyethylene terephthalate (PET), polyethylene (PE), polyvinyl chloride (PVC), polypropylene (PP), polystyrene (PS), polylactic acid (PLA), polycarbonate (PC), and acrylic (PMMA). In various examples, the adapter plate 38 may be formed from plastics combined with a structural reinforcing element such as, for example, Kevlar, fiberglass, and carbon fiber.

Still referring to FIG. 9, the holding member 50 may be coupled to the first side 54 of the adapter plate 38. In some examples, the holding member 50 may be coupled to the adapter plate 38. In other examples, the holding member 50 may be integrally formed with the adapter plate 38. In various examples, the holding member 50 may define a channel 206 extending from the front portion 136 to a rear portion 214 of the adapter plate 38. In other words, the channel 206 may extend along the adapter plate 38. The rear portion 214 may be positioned in closer proximity to the rear surface 46A (FIG. 6) of the vacuum insulated structure 14 relative to the front portion 136. In various examples, the channel 206 may extend from a first position 218 to a second position 222 where the second position 222 is closer in proximity to the bottom edge portion 202 of the adapter plate 38 relative to the first position 218 (e.g., a lower portion) such that a portion of the channel 206 defines a slope. In some examples, the channel 206 may define a sloped portion 206A and a substantially level portion 206B.

Still referring to FIG. 9, the channel 206 may be defined by first and second elongated protrusions 230, 234 extending from the first side 54 of the adapter pate 38. The first elongated member 230 may be substantially level. The second elongated member 234 may extend at a downward angle towards the bottom edge portion 202 and then extend substantially parallel to the first elongated member 230. The sloped portions of the channel 206 and the second elongated member 234 may be positioned proximate the front portion 136 of the adapter plate 38.

With further reference to FIG. 9, a rotating member 238 may be coupled to the adapter plate 38 proximate the holding member 50. The rotating member 238 may be positioned such that it is coupled to a sloped portion 234A of the second elongated member 234 proximate the front portion 136 of the adapter plate 38. In various examples, the rotating member 238 may be configured to rotate about a central axis. In some examples, the rotating member 238 may define an indentation about a circumference of the rotating member 238 to assist the rotating member 238 in receiving the positioning member 58 (FIG. 5). In other examples, the rotating member 238 may define a ridge about the circumference of the rotating member 238 to assist in receiving the positioning member 58 (FIG. 5). In various examples, the rotating member 238 and the holding member 50 may cooperate to receive and maintain the positioning member 58 (FIG. 5) within the mounting system 106.

Referring now to FIG. 10, the support member 42 may be coupled to the interior surface 46 such as, for example, the top surface 46B of the vacuum insulated structure 14. In various examples, the support member 42 may be positioned on the top surface 46B of the vacuum insulated structure 14 while maintaining a vacuum in the interior cavity 26. The panel 114 may be coupled to the support member 42 such that the panel 114 is configured to be a ceiling of the vacuum insulated structure 14 positioned proximate the top surface 46B of the vacuum insulated structure 14.

Referring still to FIG. 10, the panel 114 may include one or more protrusions 242. In some examples, the protrusions 242 may be coupled to the panel 114. In other examples, the protrusions 242 may be integrally formed with the panel 114. The protrusions 242 may be configured to correspond with the apertures 126 to removably couple the panel 114 to the support member 42. In various examples, there may be more than one support member 42 coupled to the top surface 46B of the vacuum insulated structure 14 to assist in supporting the panel 114. The panel 114 may be formed from, for example, plastic, acrylic, plexiglass, polypropylene, polycarbonate, composite materials, reinforced plastics, and metal alloys.

Figure 11:
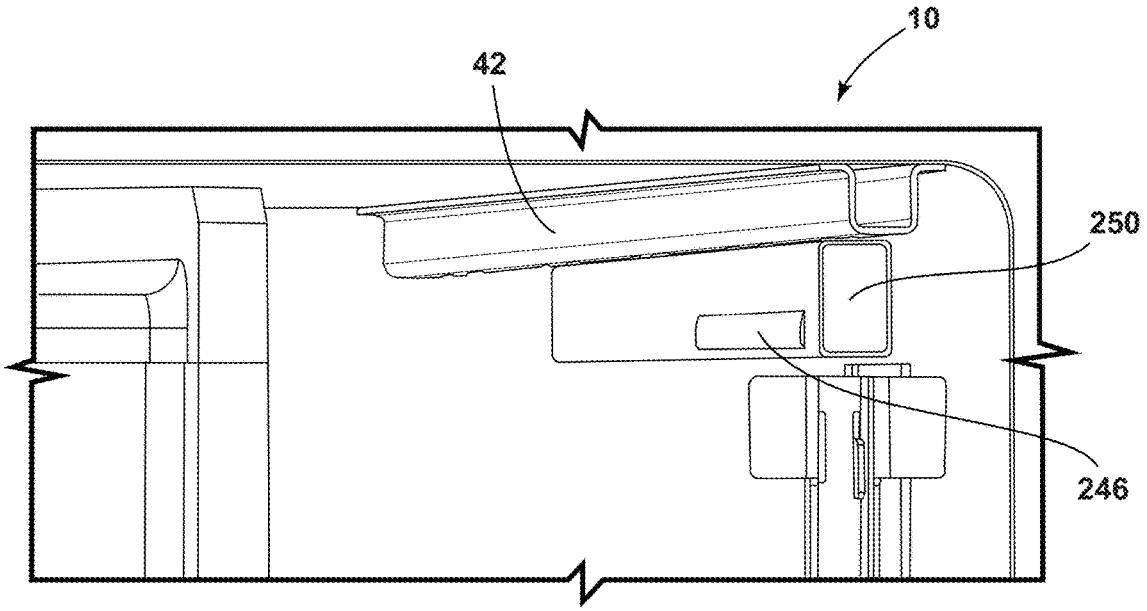
FIG. 11 is a front perspective view of the mounting system of FIG. 9 according to some embodiments of the present disclosure.

Referring to FIG. 11, the appliance 10 may include a light source 246. The light source 246 may be coupled to the support member 42. In some examples, the light source 246 may be coupled directly to the support member 42. In other examples, the light source 246 may be positioned on and/or within the panel 114 (FIG. 10) and operably coupled to the support member 42. The light source 246 may include any form of light source and may include one or more forms of light sources. For example, fluorescent lighting, light emitting diodes (LEDs), organic LEDs (OLEDs), polymer LEDs (PLEDs), solid-state lighting, or any other form of lighting configured to emit light may be utilized. According to some examples, one or more light sources 246 may be configured to emit a wavelength of light that is characterized as visible light (about 380-700 nanometers) and/or white light (about 390-700 nanometers) to take advantage of the relative low cost attributable to those types of LEDs.

Still referring still to FIG. 11, in some examples, the support member 42 may additionally or alternatively be configured to support a component of a refrigeration system 250 of the appliance 10. The component of the refrigeration system 250 may include, for example, a compressor, a fan, a condenser, an evaporator, an expansion valve, and/or a combination thereof. In some examples, the component of the refrigeration system 250 may be coupled directly to the support member 42. In other examples, the component of the refrigeration system 250 may be positioned on and/or within the panel 114 (FIG. 10) and operably coupled to the support member 42.

Figure 12:
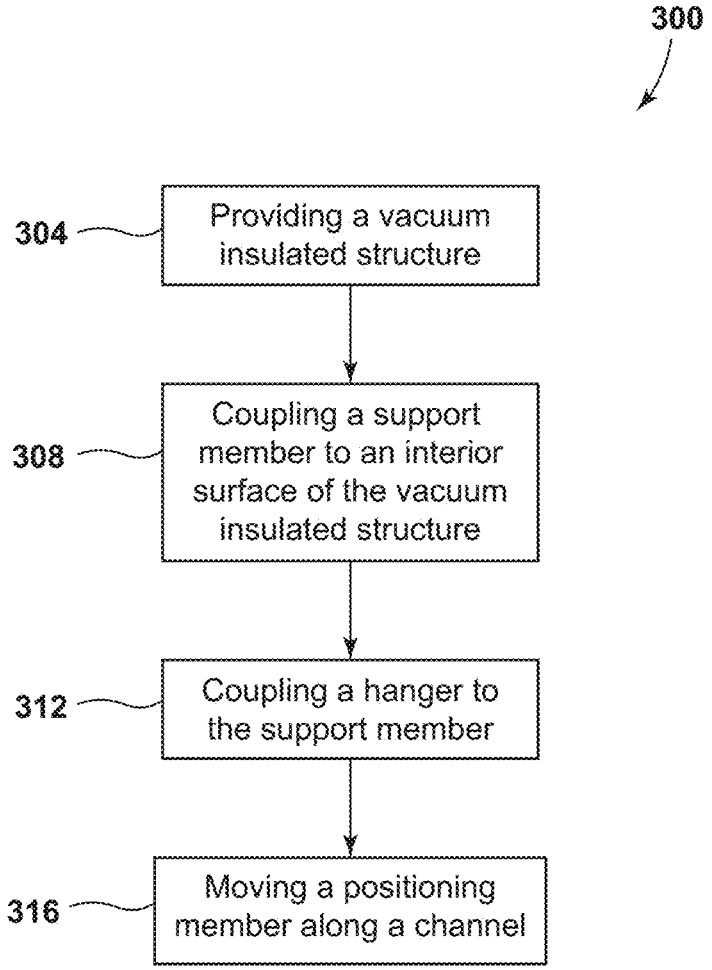
FIG. 12 is a flowchart of a method for supporting a positioning member in an appliance according to some embodiments of the present disclosure.

Referring to FIG. 12, and additionally referring to FIGS. 1-11, a method 300 of supporting the positioning member 58 in the appliance 10 is provided. The method 300 includes a step 304 of providing the appliance 10 including the vacuum insulated structure 14. The vacuum insulated structure 14 may have the insulating material 30 positioned within the interior cavity 26 defined by the liner 18 and the wrapper 22. The appliance 10 may include the refrigerator compartment 66, the freezer compartment 70, and/or a combination thereof.

The method 300 may include a next step 308 of coupling the support member 42 to the interior surface 46 of the vacuum insulated structure 14. The support member 42 may be coupled to the rear surface 46A of the vacuum insulated structure 14. In other examples, the support member 42 may be coupled to the top surface 46B of the vacuum insulated structure 14. In still other examples, the support member 42 may be coupled to the rear surface 46A and the top surface 46B.

A next step 312 of the method 300 may include coupling the hanger 34 to the support member 42 by connecting the corresponding hook 170 with one of the apertures 126 of the support member 42. In some examples, the hanger 34 may be coupled to the support member 42 by connecting the corresponding first flange 174 with one of the apertures 126 of the support member 42 and/or connecting the corresponding second flange 182 with the support member 42. In various examples, the hanger 34 may additionally be coupled to the adapter plate 38. In some examples, the holding member 50 may be coupled to the adapter plate 38.

A next step 316 of the method 300 may include placing the positioning member 58 about the rotating member 238. The positioning member 58 may be positioned proximate the rotating member 238 and moved along the channel 206 defined by the holding member 50.

Figure 13:
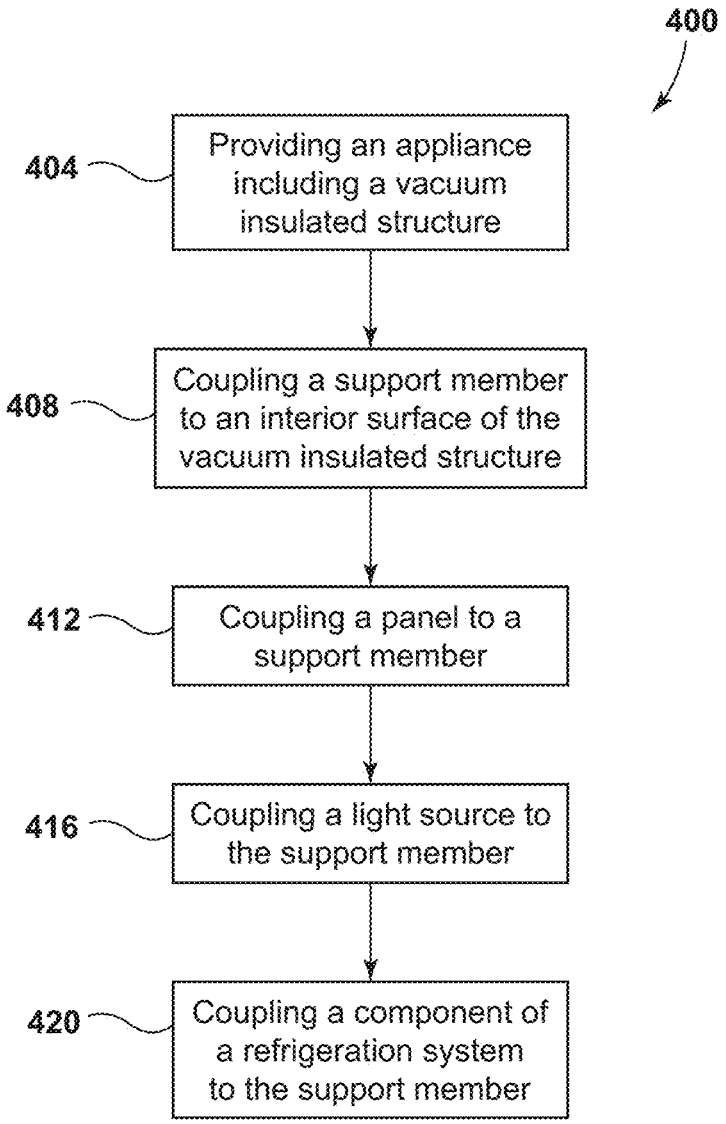
FIG. 13 is a flowchart of a method for coupling a panel, a light source, and/or a component of a refrigeration system to a top surface of a vacuum insulated structure according to some embodiments of the present disclosure.

Referring to FIG. 13, and additionally referring to FIGS. 1-11, a method 400 for coupling the panel 114, light source 246, and/or the component of the refrigeration system 250 to the top surface 46B of the vacuum insulated structure 14 is provided. The method 400 may include a step 404 of providing the appliance 10 including the vacuum insulated structure 14. The vacuum insulated structure 14 may have the insulating material 30 positioned within the interior cavity 26 defined by the liner 18 and the wrapper 22.

The method 400 may include a next step 408 of coupling the support member 42 to the interior surface 46 of the vacuum insulated structure 14. In some examples, the support member 42 may be coupled to the top surface 46B of the vacuum insulated structure 14. In still other examples, the support member 42 may be coupled to the rear surface 46A and the top surface 46B.

A next step 412 of method 400 may include coupling the panel 114 to the support member 42. In various examples, the protrusions 242 may be aligned with and inserted into the apertures 126 of the support member 42.

A next step 416 of method 400 may include coupling the light source 246 to the support member 42. In various examples, the light source 246 may be coupled directly to the support member 42. In other examples, the light source 246 may be coupled to the top surface 46B and/or the rear surface 46A of the vacuum insulated structure 14 and wiring connected to the light source 246 may be supported by the support member 42.

A next step 420 of method 400 may include coupling the component of the refrigeration system 250 to the support member 42. In various examples, the component of the refrigeration system 250 may be coupled directly to the support member 42. In other examples, the component of the refrigeration system 250 may be coupled to the top surface 46B and/or the rear surface 46A of the vacuum insulated structure 14 and components extending from the refrigeration system 250 may be supported by the support member 42.

It will be understood by one having ordinary skill in the art that construction of the described device and other components may not be limited to any specific material. Other exemplary embodiments of the device disclosed herein may be formed from a wide variety of materials, unless described otherwise herein.

For purposes of this disclosure, the term "coupled" (in all of its forms, couple, coupling, coupled, etc.) generally means the joining of two components (electrical or mechanical) directly or indirectly to one another. Such joining may be stationary in nature or movable in nature. Such joining may be achieved with the two components (electrical or mechanical) and any additional intermediate members being integrally formed as a single unitary body with one another or with the two components. Such joining may be permanent in nature or may be removable or releasable in nature unless otherwise stated.

It is also important to note that the construction and arrangement of the elements of the device as shown in the exemplary embodiments is illustrative only. Although only a few embodiments of the present innovations have been described in detail in this disclosure, those skilled in the art who review this disclosure will readily appreciate that many modifications are possible (e.g., variations in sizes, dimensions, structures, shapes and proportions of the various elements, values of parameters, mounting arrangements, use of materials, colors, orientations, etc.) without materially departing from the novel teachings and advantages of the subject matter recited. For example, elements shown as integrally formed may be constructed of multiple parts or elements shown as multiple parts may be integrally formed, the operation of the interfaces may be reversed or otherwise varied, the length or width of the structures and/or members or connector or other elements of the system may be varied, the nature or number of adjustment positions provided between the elements may be varied. It should be noted that the elements and/or assemblies of the system may be constructed from any of a wide variety of materials that provide sufficient strength or durability, in any of a wide variety of colors, textures, and combinations. Accordingly, all such modifications are intended to be included within the scope of the present innovations. Other substitutions, modifications, changes, and omissions may be made in the design, operating conditions, and arrangement of the desired and other exemplary embodiments without departing from the spirit of the present innovations.

It will be understood that any described processes or steps within described processes may be combined with other disclosed processes or steps to form structures within the scope of the present device. The exemplary structures and processes disclosed herein are for illustrative purposes and are not to be construed as limiting.

It is also to be understood that variations and modifications can be made on the aforementioned structure without departing from the concepts of the present disclosure, and further it is to be understood that such concepts are intended to be covered by the following claims unless these claims by their language expressly state otherwise.

The above description is considered that of the illustrated embodiments only. Modifications of the device will occur to those skilled in the art and to those who make or use the device. Therefore, it is understood that the embodiments shown in the drawings and described above is merely for illustrative purposes and not intended to limit the scope of the device, which is defined by the following claims as interpreted according to the principles of patent law, including the Doctrine of Equivalents.

What is claimed is:

1. A method for coupling a storage feature to an appliance, comprising:

providing a vacuum insulated structure that includes a liner defining an interior compartment;

coupling a support member to an interior surface of the liner, wherein the support member defines apertures;

coupling a hanger to the support member, the hanger including a hook that extends through a selected one of the apertures of the support member;

coupling an outer side of an adapter plate to the hanger, the adapter plate defining a holding member with a receiving channel on an inner side of the adapter plate;

coupling a cover to a top edge of the adapter plate to form a shelf;

coupling a roller to the holding member proximate to an entrance to the receiving channel;

engaging a lower portion of said storage feature with the roller to promote movement of said storage feature along the receiving channel;

moving said storage feature along the receiving channel and below the cover with the movement of said storage feature being guided by rotation of the roller; and engaging said storage feature with the holding member of the adapter plate.

2. The method of claim 1, wherein the step of coupling the support member to the interior surface of the liner includes:

coupling the support member to a rear surface of the liner.

3. The method of claim 1, wherein the step of providing the vacuum insulated structure includes:

coupling the liner and a wrapper to an insulating thermal bridge to form an insulating cavity;

dispensing an insulating material in the insulating cavity; and evacuating the insulating cavity to form a vacuum therein.

4. The method of claim 3, wherein the step of coupling the support member to the interior surface of the liner includes:

maintaining the vacuum within the insulating cavity while coupling the support member to the liner.

5. The method of claim 1, further comprising:

coupling a second support member to the interior surface of the liner, wherein the second support member defines apertures;

coupling a second hanger to the second support member, the second hanger including a hook that extends through a selected one of the apertures of the second support member; and coupling an outer side of a second adapter plate to the second hanger, the second adapter plate defining a second holding member on an inner side of the second adapter plate.

6. The method of claim 5, wherein the step of engaging said storage feature with the holding member of the adapter plate further includes:

slidably engaging said storage feature with each of the holding member of the support member and the second holding member of the second support member, wherein said storage feature forms a slidable drawer.

7. The method of claim 5, wherein the step of engaging said storage feature with the holding member of the adapter plate further includes:

engaging said storage feature with each of the holding member of the support member and the second holding member of the second support member.

8. The method of claim 5, wherein the step of coupling the second support member to the interior surface of the liner includes:

positioning the second support member parallel to and spaced from the support member; and coupling the second support member to a rear surface of the liner spaced from the support member.

9. The method of claim 5, further comprising:

coupling the cover to a top edge of the second adapter plate to form the shelf.

10. The method of claim 9, further comprising:

coupling a border member to the cover along at least a front edge of the cover.

11. The method of claim 10, wherein the step of coupling the cover to the top edges of the adapter plate and the second adapter plate includes:

coupling a first bracket to the cover and the outer side of the adapter plate; and coupling a second bracket to the cover and the outer side of the second adapter plate.

12. The method of claim 1, wherein the step of coupling the outer side of the adapter plate to the hanger includes:

positioning a curved top edge of the hanger in at least one cavity defined by the second side of the adapter plate.

13. The method of claim 1, wherein the step of coupling the support member to the interior surface of the liner includes:

coupling the support member to the interior surface via at least one of welding and adhesive.

14. The method of claim 1, further comprising:

moving said storage feature along the receiving channel until a front panel of said storage feature is disposed adjacent to the cover to enclose an interior of said storage feature.

15. The method of claim 1, wherein the step of engaging the lower portion of said storage feature with the roller includes:

engaging said storage feature with one of an indent and a ridge extending along a circumference of the roller.

* * * * *